US008602119B2

(12) United States Patent
Wagner

(10) Patent No.: US 8,602,119 B2
(45) Date of Patent: Dec. 10, 2013

(54) METHOD AND DEVICE FOR PREVENTING AND/OR EXTINGUISHING FIRES IN ENCLOSED SPACES

(75) Inventor: Ernst-Werner Wagner, Winsen/Aller (DE)

(73) Assignee: Amrona AG, Zug (CH)

( * ) Notice: Subject to any disclaimer, the term of this patent is extended or adjusted under 35 U.S.C. 154(b) by 190 days.

(21) Appl. No.: 12/216,973

(22) Filed: Jul. 14, 2008

(65) Prior Publication Data

US 2009/0014187 A1 Jan. 15, 2009

(30) Foreign Application Priority Data

Jul. 13, 2007 (EP) ..... 07112442

(51) Int. Cl.
*A62C 3/00* (2006.01)

(52) U.S. Cl.
USPC ..... 169/46; 169/9; 169/11; 169/16; 169/54; 169/56; 169/61

(58) Field of Classification Search
USPC ..... 169/5, 6, 7, 9, 11, 16, 27, 46, 47, 54, 169/56, 60, 61; 62/50.2
See application file for complete search history.

(56) References Cited

U.S. PATENT DOCUMENTS

| | | | | |
|---|---|---|---|---|
| 4,091,874 | A * | 5/1978 | Monma | 169/46 |
| 5,197,548 | A * | 3/1993 | Volker et al. | 169/11 |
| 5,327,732 | A * | 7/1994 | De Almeida | 62/50.2 |
| 5,368,105 | A * | 11/1994 | Chaiken et al. | 169/44 |
| 6,401,830 | B1 * | 6/2002 | Romanoff | 169/46 |
| 6,502,421 | B2 * | 1/2003 | Kotliar | 62/640 |
| 6,763,894 | B2 * | 7/2004 | Schoenrock et al. | 169/47 |
| 2004/0045725 | A1 | 3/2004 | Shaw et al. | |
| 2006/0213673 | A1 | 9/2006 | Kotliar | |

FOREIGN PATENT DOCUMENTS

| | | | |
|---|---|---|---|
| CL | 45.263 | | 6/2009 |
| DE | 4018265 | | 11/1991 |
| DE | 19811851 | | 9/1999 |
| DE | 10311556 | | 9/2004 |
| JP | 10-238918 | A | 9/1998 |
| JP | 2001-340482 | A | 12/2001 |
| RU | 2018331 | C1 * | 8/1994 |
| RU | 2201775 | C1 | 4/2003 |
| RU | 2256472 | C2 | 7/2005 |

* cited by examiner

*Primary Examiner* — Steven J Ganey
(74) *Attorney, Agent, or Firm* — Jean C. Edwards, Esq.; Edwards Neils PLLC

(57) ABSTRACT

The invention relates to a preventing and extinguishing fires in enclosed spaces in which the internal air atmosphere is not permitted to exceed a predefined temperature value. In order not to have to increase the cooling capacity of an air conditioning system when inert gas is added to the internal air atmosphere to set or maintain a specific inertization level within an enclosed space, a system for the regulated discharging of inert gas into same is provided. The system includes a container for the provision and storage of the inert gas in liquified form, and a vaporizer connected to the container for vaporizing at least a portion of the inert gas and discharging same into the internal air atmosphere of the enclosed space. The vaporizer thereby directly or indirectly extracts the heat energy needed to vaporize the liquid inert gas from the internal air atmosphere of the enclosed space.

13 Claims, 3 Drawing Sheets

METHOD AND DEVICE FOR PREVENTING AND/OR EXTINGUISHING FIRES IN ENCLOSED SPACES

CROSS-REFERENCE TO RELATED APPLICATIONS

The present invention claims priority from European Patent Application No. 07 112 442.4 filed Jul. 13, 2007, the contents of which are herein incorporated by reference in their entirety.

BACKGROUND OF THE INVENTION

1. Field of the Invention

The present invention relates to a method as well a device for preventing and/or extinguishing fires in enclosed spaces in which the internal air atmosphere is not permitted to exceed a predefined temperature value.

2. Description of the Related Art

An enclosed space where the internal air atmosphere may not exceed a predefined temperature, such as for example a cold storage, archive or IT area, is usually equipped with an air conditioning system in order to air condition the space accordingly. The air conditioning system is designed and correspondingly dimensioned such that a sufficient amount of heat, thermal energy respectively, can be discharged from the internal air atmosphere within the enclosed space so as to maintain the temperature inside the space within a predefined range. In the case of a cold storage area, for example, the temperature to be maintained is usually of a value which requires virtually permanent cooling and thus, the continuous operation of an air conditioning system, since temperature fluctuations are preferably also to be avoided in this case. This applies in particular to deep-freeze storage areas which are operated at temperatures to −20° C.

Air conditioning systems are however also utilized in IT rooms or switchgear cabinets, for example, in order to prevent—in particular due to the heat produced within the space by electronic components, etc.—the temperature of the internal air atmosphere within the space from reaching a critical value.

The air conditioning system is thereby to be dimensioned such that a sufficient amount of heat can be discharged from the internal air atmosphere within the space at any time so that the temperature within the space will not exceed the temperature predefined based on need and application.

The amount of heat to be discharged by the air conditioning system from the internal air atmosphere within the space is dependent on the flow of heat diffused through the inside shell of the space (heat conduction). Should heat-radiating objects be located in the enclosed space, the heat generated within the space adds to the further not insignificant amount of heat to be discharged to the outside. In particular in the case of areas housing servers, but also in the case of switchgear cabinets housing computer components, sufficiently discharging the heat which develops plays a crucial role in effectively preventing overheating and malfunction or even destruction of the electronic components.

As a fire prevention method for enclosed spaces which people only enter occasionally, for example, and in which the equipment therein reacts sensitively to the effects of water, it is known to address a risk of fire by lowering the oxygen concentration in the space's internal air atmosphere to a specific inertization level of e.g., 15% by volume or lower oxygen content on a sustained basis. Lowering the oxygen concentration—in comparison to the almost 21% by volume oxygen level of natural ambient air—considerably reduces the inflammability of most flammable materials.

The main area of application for this type of "inerting technology," as the flooding of an area at risk of fire with oxygen-displacing gas such as carbon dioxide, nitrogen, noble gases or mixtures of these gases is called, are IT areas, electrical switchgear and distributor compartments, enclosed facilities as well as storage areas for high-value commodities.

However, employing the inerting technology in spaces in which the internal air atmosphere cannot exceed a predefined temperature value is coupled with certain problems. This is due to the fact that inert gas must be regularly or continually added to the internal air atmosphere of the space so as to maintain the inertization level set for the internal air atmosphere. Otherwise, depending on the space's air tightness and air change rate, the specifically-set oxygen concentration gradient between the internal air atmosphere of the enclosed space on the one hand and the external ambient air on the other would sooner or later be abolished.

Therefore, conventional systems which use inerting technology for fire prevention are usually equipped with a system to provide an oxygen-displacing (inert) gas. This system is thereby designed, subject to the oxygen content in the internal air atmosphere of the space, to feed a sufficient amount of inert gas into the space to maintain the inertization level. A nitrogen generator connected to an air compressor lends itself particularly well to a system for providing an inert gas, providing direct on-site generating of the inert gas as needed (here, i.e., the nitrogen-charged air). Such a nitrogen generator effects compression of the normal outside air in a compressor and separation into nitrogen-enriched air and residual gases with hollow fiber membranes. While the residual gases are discharged to the outside, the nitrogen-charged air replaces a portion of the atmospheric air in the enclosed space and thereby reduces the necessary oxygen percentage.

The supplying of the nitrogen-charged air is normally activated as soon as the oxygen concentration in the internal air atmosphere of the space exceeds a predefined threshold. The pre-defined threshold is set subject to the inertization level to be maintained.

Using such a system to prevent fires in spaces in which the internal atmospheric air may not exceed a predefined temperature is coupled with certain disadvantages since introducing thermal energy (heat) into the internal air atmosphere of the space is also unavoidable due to the regular or continual addition of inert gas. The air conditioning system then also needs to subsequently discharge this additionally-introduced thermal energy. Hence, the air conditioning system used must be of accordingly larger dimensioning. It is in particular to be ensured that the additional thermal energy resulting inside the space as a consequence of the continuous or regular adding of inert gas can also be effectively discharged again. It is thereby to be additionally considered that the nitrogen-charged air produced in a nitrogen generator and fed into the space is usually of an increased temperature compared to the temperature of the ambient outside air.

Even when a nitrogen generator is not used to provide inert gas, but instead gas bottles, etc., are used to store the inert gas in compressed state, it must be considered that additional thermal energy is often introduced into the internal air atmosphere of the space in this case as well. There is therefore likewise the risk that additional increases in temperature will occur which need to be accordingly compensated by the air conditioning system.

It can therefore, be established that the use of a conventional inerting system in enclosed spaces in which the internal air atmosphere may not exceed a predefined temperature value is coupled with increased operating costs since the air conditioning system needed to air condition the space must be of correspondingly larger dimensioning.

SUMMARY OF THE INVENTION

Based on this problem as set forth, the task of the present invention is thus, based on specifying a method and a device for preventing fires in enclosed spaces in which an air conditioning system, etc., is used to keep the internal air atmosphere of the space within a predefined temperature range, whereby the cooling capacity provided by the air conditioning system does not need to be increased even when inert gas is continuously or regularly added to the internal air atmosphere of the space so as set or maintain a specific inertization level within said enclosed space.

This task is solved by a method of the type cited at the outset which initially has a liquefied inert gas (such as nitrogen, for example) provided in a container, subsequently feeding a portion of the inert gas supply to a vaporizer to be vaporized in same, and lastly feeding the vaporized inert gas from the vaporizer to the internal air atmosphere within the space in regulated manner such that the oxygen content in the atmosphere of the enclosed space either drops to a specific inertization level and/or is maintained at a specific (preset) inertization level. The invention in particular provides for directly or indirectly extracting the heat energy needed for vaporizing the liquid inert gas from the internal air atmosphere of the enclosed space.

With respect to the device, the task underlying the invention is inventively solved by the device of the type cited at the outset on the one hand including an oxygen-measuring mechanism for measuring the oxygen content in the internal air atmosphere and, on the other, a system for the regulated discharging of inert gas into the internal air atmosphere of the enclosed space. It is specifically provided for the system to include a container for the provision and storage of the inert gas in liquefied form and a vaporizer connected to said container. The vaporizer serves on the one hand to vaporize at least a portion of the inert gas provided in the container and, on the other, to feed the vaporized inert gas into the internal air atmosphere of the enclosed space. The device in accordance with the solution further encompasses a controller designed to control the system supplying the inert gas subject to the measured oxygen content such that the oxygen content in the atmosphere of the enclosed space drops to a specific inertization level and/or is maintained at a specific (preset) inertization level. The vaporizer is thereby in particular designed to directly or indirectly extract the heat energy needed to vaporize the liquid inert gas from the internal air atmosphere of the enclosed space.

The term "inertization level" as used herein is to be understood as a reduced oxygen content in comparison to the oxygen content of the normal ambient air. Reference is also made to a "basic inertization level" when the reduced oxygen content set in the internal air atmosphere of the space does not pose any danger to people or animals so that same can continue to freely enter the enclosed space without any problems. The basic inertization level corresponds to an oxygen content for the internal air of the enclosed space of, for example, 13% to 17% by volume.

Conversely, the term "full inertization level" refers to an oxygen content which has been reduced further compared to the oxygen content of the basic inertization level and at which the inflammability of most material is already lowered to the point of no longer being ignitable. Depending on the fire load within the enclosed space, the oxygen content at the full inertization level is normally at 11% or 12% by volume. Of course, other values are also conceivable here.

The advantages attainable with the inventive solution are obvious. Taking the heat energy needed to vaporize the liquid inert gas in the vaporizer from the internal air atmosphere of the enclosed space achieves—concurrently with the replenishing or discharging of inert gas into the internal air atmosphere—a cooling effect within the space. This cooling effect can be used to ensure the internal air atmosphere within the space does not exceed the predefined temperature level. By capitalizing on this synergistic effect—despite employment of the inerting system—the cooling performance rendered by an air conditioning system can be maintained or even reduced.

The device according to the invention concerns the technical mechanism designed to realize the inventive method of providing preventive fire protection in spaces in which the internal atmospheric air may not exceed a predefined temperature level.

Advantageous embodiments of the method according to the invention are discussed below.

In one realization of the solution according to the invention, the inert gas supplied is vaporized within the enclosed space. It is hereby provided for the inert gas to be fed in liquid form to a vaporizer disposed within said space before same is vaporized. This is a particularly simple to realize and yet effective approach to extracting a specific amount of heat (heat of vaporization) from the internal air atmosphere of the space by vaporizing the fluid inert gas within said space and cooling the space without using an air conditioning system.

Alternatively hereto, however, it is also conceivable that the inert gas supplied is not vaporized within but rather external the enclosed space. In so doing, it is advantageous for at least a portion of the heat energy needed to vaporize the inert gas to be extracted from the internal air atmosphere of the enclosed space by heat conduction. It is thus conceivable in this embodiment to use a vaporizer external the enclosed space, for example. A heat exchanger, designed so as to enable heat transfer from the internal air atmosphere of the enclosed space to the inert gas to be vaporized in the vaporizer, is preferably allocated to the vaporizer.

In the latter embodiment cited, in which the inert gas is vaporized external the enclosed space, it is advantageous to be able to regulate by heat conduction the amount of heat energy extracted from the internal air atmosphere of the space to vaporize the inert gas. This can be realized, for example, by being able to set the heat conductivity of a heat conductor used to extract the required heat energy. The heat conductivity of the heat conductor is hereby preferably set as a function of the actual temperature; i.e., the current and measured temperature in the enclosed space, and/or a predefinable target temperature.

In realizing this embodiment, it is preferable for the device to further include a temperature-measuring mechanism for measuring the temperature of the internal air atmosphere in the enclosed space in order to be able to determine the actual temperature prevailing within the enclosed space on a continual basis or at preset times and/or upon the occurrence of pre-defined events. The heat conductivity of the heat conductor used to extract the heat energy needed for vaporization can then be set as a function of the actual temperature measured. It is specifically conceivable to use a heat exchanger having a heat transfer unit to transfer the heat energy from the internal air atmosphere of the space to the inert gas to be vaporized in the vaporizer. In so doing, the efficiency ratio of the heat transfer unit should be able to be set by the controller as a function of the actual temperature measured and/or a predefinable target temperature.

So that the heat energy necessary to vaporize the inert gas can be at least partly extracted from the internal air atmosphere of the enclosed space by heat conduction and fed to the vaporizer, it is conversely also conceivable for the solution according to the invention to make use of a so-called "unit cooler." A unit cooler in the sense of the present invention is an evaporator which can be kept at a "moderate" temperature at which it is possible to convert the inert gas from its liquid aggregate state into its gaseous aggregate state using the internal ambient air of the enclosed space.

The technical principle underlying a unit cooler can be realized in a particularly simple and fail-safe manner. It is thus, conceivable for the unit cooler to consist of aluminum tubing with longitudinal ribs. This type of unit cooler works in particular without additional external power, i.e., by heat exchange with a volume of air extracted from the internal atmosphere of the enclosed space alone. This permits the liquefied inert gas to be vaporized and heated to almost the temperature of the internal air atmosphere within the space. At the same time, the heat energy necessary to vaporize the inert gas is preferably extracted by heat conduction from the air fed as heated air to the vaporizer, the heat exchanger of the vaporizer respectively, such that this volume of air is cooled accordingly. As this cooled air is then subsequently fed back into the space again, the cooling effect ensuing from the vaporization of the inert gas can be directly used to cool the space. In particular, an air conditioning system used to air condition the space can thus, be of a smaller dimension.

This cooling effect is specifically independent of the cooling efficiency of an air conditioning system used to air condition the enclosed space. In particular, the present embodiment employs a unit cooler having a heat exchanger, whereby the heat exchanger makes use of the inert gas to be supplied to the enclosed space on the one hand (as the medium to be heated) and a portion of the air from the internal air atmosphere (as the medium to be cooled) on the other.

The heat exchanger of the unit cooler in this embodiment is preferably connected to the enclosed space by means of an air duct system so that, on the one hand, the heat exchanger can be fed heated air (as the medium to be cooled) from the internal air atmosphere of the space. On the other hand, after the vaporization of the liquefied inert gas, the air duct system is used to re-introduce the air supplied to the heat exchanger of the unit cooler back into the enclosed space as cooled (cooling) air. It is particularly preferred for the air duct system to make use of at least one hot air duct for discharging the air from the internal air atmosphere of the space which, however, concurrently also serves in the supplying of heated air from the internal air atmosphere to an air conditioning system used to air condition the enclosed space as needed.

Inversely, it is further preferred after the vaporization of the inert gas to re-introduce the (heated) air supplied to the heat exchanger of the air cooler back into the enclosed space as cooled (cooling) air through a cold air duct, whereby this cold air duct can also simultaneously serve as needed in the feeding of the cooled air back into the internal air atmosphere for the air conditioning system used to air condition the enclosed space.

Having the air conditioning system on the one hand and the heat exchanger of the unit cooler on the other share the use of the hot air duct and the cold air duct enables the inventive solution to be employed in an enclosed space without requiring major constructional arrangements since, in particular, no additional cold air ducts need to be provided.

Lastly, yet another advantage to be cited with regard to the device is that the heat exchanger can also be configured as a component of an air conditioning system used to air condition the enclosed space. It is for example conceivable for the air conditioning system itself to comprise a heat exchanger through which a portion of the air from the internal air atmosphere within the space is routed in order to transfer thermal energy from the air to a cooling medium. Preferably, the heat exchanger of the air conditioning system is then connected upstream or downstream of the heat exchanger of the vaporizer.

In the latter cited embodiment using a unit cooler with a heat exchanger, it is preferred to provide for setting the amount of the air fed to the heat exchanger as heated air as a function of the actual temperature and/or a predefinable target temperature. It is hereto advantageous for a temperature-measuring mechanism to be further provided to measure the actual temperature in the internal air atmosphere of the enclosed space.

With respect to the inert gas used in the inventive solution, it is preferably provided to store same in the container in a saturated state. In particular, the inert gas should thereby be stored at a temperature a few degrees below the critical point of the inert gas.

If, for example, nitrogen is used as the inert gas, its critical temperature being −147° C. and its critical pressure being 34 bar, it is preferable for the nitrogen to be stored at a pressure ranging from 25 to 33 bar, preferably 30 bar, and at the corresponding saturation temperature. In so doing, it is to be considered that the container pressure should be sufficiently high enough so that the storage pressure can force the inert gas out as fast as possible to the vaporizer. Preferably assumed hereby is a storage pressure of from 20 to 30 bar such that the lines which connect the container for storing the liquefied inert gas to the vaporizer can have the smallest diameter possible. At a storage pressure of 30 bar, for example, the saturation temperature would be −150° C., whereby this would provide for maintaining the sufficient distancing from the critical temperature of −147° C.

The solution according to the invention is not, however, solely applicable to fire prevention encompassing decreasing the inflammability of the goods stored in the enclosed space by the preferably sustained lowering of the oxygen content in the internal air atmosphere of said enclosed space. It is instead also conceivable that in the event of a fire or when otherwise needed, the oxygen content in the internal air atmosphere of the space is further lowered to a specific full inertization level and is done so by the regulated supplying of inert gas into the internal air atmosphere of the space.

The setting (and maintaining) of the full inertization level can ensue for the purpose of fire extinguishing, for example. It is preferable in this case for the device to further include a fire detection device to measure a fire characteristic in the atmosphere of the enclosed space.

The term "fire characteristic" as used herein is to be understood as a physical variable which is subject to measurable changes in the proximity of an incipient fire, e.g., ambient temperature, solid, liquid or gaseous content in the ambient air (accumulation of smoke particles, particulate matter or gases) or the ambient radiation.

When employing the inventive solution to extinguish fires, it is thus, conceivable for the drop down to the full inertization level to be subject to a fire characteristic value measured by the detector.

On the other hand, however, it is also conceivable for the drop down to the full inertization level to be subject to the merchandise stored in the enclosed space, and in particular its ignition behavior. It is therefore possible to also set a full inertization level as a fire prevention measure, for example in areas in which particularly highly flammable goods are stored.

To lower the oxygen content in the internal air atmosphere of the enclosed space to the full inertization level, it is conceivable for the full inertization level to be set by automated production and subsequent introduction of an oxygen-displacing gas. It is however likewise possible for the inert gas which is to be supplied or replenished in order to set and maintain the full inertization level to be provided in the container preferably configured as a cooling tank and vaporized with the vaporizer.

It is obvious that the solution according to the invention can be utilized as a fire prevention measure in an enclosed cold storage facility or in an IT or similar area, wherein the internal air atmosphere of the space is not allowed to exceed a specific temperature value. Moreover, the solution according to the invention is also in particular preferably applicable to fire prevention for enclosed switchgear cabinets or other such similar constructions in which the internal air atmosphere is likewise not allowed to exceed a specific temperature.

BRIEF DESCRIPTION OF THE DRAWINGS

The following will make reference to the figures in describing preferred embodiments of the inventive device in greater detail.

DESCRIPTION OF THE INVENTION

Figure 1:
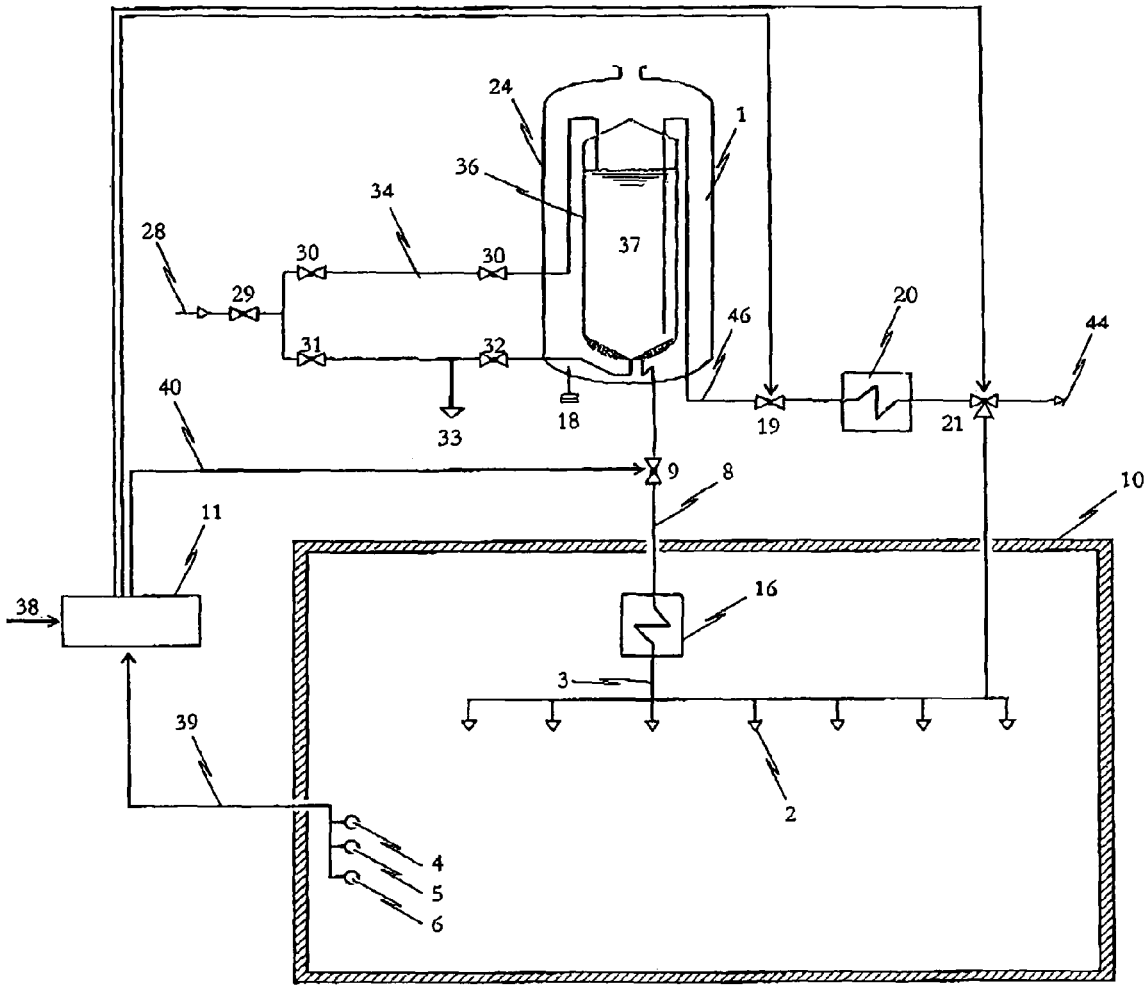
FIG. 1 is a schematic view of a first embodiment of the device according to the invention.

FIG. 1 schematically depicts a first realization of the solution according to the invention. Hereby, a fire prevention measure is being employed in an air-conditioned space 10. The space 10 is for example a cold storage area or an IT room; i.e., an area in which the internal air atmosphere is not permitted to exceed a predefined temperature value.

To air condition the space 10, an air conditioning system not explicitly shown in the figures can be employed, the functioning of which will not be specifically detailed here. To briefly summarize, the air conditioning system should be designed such that same can extract a sufficient amount of heat from the internal air atmosphere of the space 10 so that the temperature within the interior of space 10 can be maintained within a predefined temperature range.

The invention indicates a fire prevention measure for air-conditioned spaces, for example cold storage areas or IT rooms. The solution according to the invention is characterized by either directly or indirectly using the cooling effect which occurs upon vaporizing an inert gas introducible into the internal air atmosphere as needed to cool the space 10. Accordingly, the inventive solution can achieve a corresponding reduction in the cooling performance rendered by the air conditioning system. This not only reduces the operating costs for the entire system but even enables the correspondingly smaller dimensioning of the air conditioning system for space 10 as early as the planning stage.

The first embodiment in accordance with FIG. 1 provides for storing an inert gas, for example nitrogen, in liquefied form in a container 1, realized here as a cooling tank. So that a specific inertization level can be set and maintained for fire prevention purposes in the internal air atmosphere of the enclosed space 10, a vaporizer 16, only depicted schematically in FIG. 1, is supplied a portion of the inert gas 37 stored in liquid form in container 1 via a liquid gas supply line 8.

In the system depicted schematically in FIG. 1, the vaporizer 16 is disposed inside the enclosed space 10. Vaporizer 16 can be, for example, a unit cooler which is at least partly enveloped by the atmospheric air of the enclosed space. It is thus firstly possible for the vaporizer 16 to be maintained at almost the temperature of the internal air atmosphere of the space and that, secondly, the inert gas fed to the vaporizer 16 in liquid form can be converted into its gaseous aggregate state and thus, vaporized. While the vaporizer 16 itself may briefly cool off during the vaporizing of the inert gas, it will then be heated up again by the internal air atmosphere within the space.

So that the inert gas 37 supplied in liquid form to the vaporizer 16 can pass into its gaseous aggregate state, it is necessary for the vaporizer to furnish the so-called "heat of vaporization." This refers to a specific amount of heat (thermal energy) which needs to be supplied to the inert gas to be vaporized in order to overcome the intermolecular force acting in the liquid aggregate state.

In the first embodiment depicted in FIG. 1, the vaporizer takes the amount of heat needed to vaporize the inert gas 37 directly from the internal air atmosphere of the enclosed space 10, since the vaporizer 16 is disposed inside said space 10. Therefore, thermal energy is extracted from the internal air atmosphere of space 10 when the liquid inert gas 37 is vaporized, a consequence of which is the cooling of the internal air atmosphere of space 10 accordingly. This cooling effect, used to cool the internal air atmosphere of space 10, particularly occurs when inert gas is discharged into the internal air atmosphere of space 10.

As depicted, the vaporizer 16 is connected downstream inert gas line 3 through which the inert gas vaporized in vaporizer 16 is fed in gaseous state to the outlet nozzles 2.

Specifically, the liquid inert gas 37 is supplied from container 1 to vaporizer 16 in a manner regulated by a controller 11. To this end, a valve 9, correspondingly actuatable by controller 11, is allocated to the fluid gas line 8.

The volume of inert gas to be vaporized in vaporizer 16 and subsequently discharged into space 10 is preferably regulated by means of the controller 11 correspondingly initiating the actuation of valve 9. The controller 11 sends a control signal hereto via control line 40 to the valve 9 associated with fluid gas supply line 8. The valve 9 can thereby be opened and closed so that a specific portion of the inert gas 37 stored in container 1—after being fed to the vaporizer 16 and vaporized there—can be discharged as needed into the internal air atmosphere of the space 10.

The controller 11 should in particular be designed such that it independently sends a corresponding control signal to valve 9 when inert gas needs to be added to the internal air atmosphere of the enclosed space 10 so as to set the oxygen content of the internal air atmosphere within the space to a specific inertization level or to maintain a specific inertization level. Keeping the oxygen content of the ambient atmospheric air at a specific inertization level by the regulated supply of inert gas provides a continuous inertization in space 10 which enables the prevention of fires.

The inertization level to be set or maintained in space 10 by the regulated supplying or replenishing of inert gas is preferably selected based on the fire load of enclosed space 10. It is thus, for example, conceivable to set a relatively lower oxygen content in the internal air atmosphere of the space, for example of approximately 12% by volume, 11% by volume or lower, when highly flammable material or goods are stored within said space 10.

Conversely, it is of course also conceivable for the controller 11 to control valve 9 such that—based on an oxygen content of about 21% by volume—a specific inertization level is first generated and then maintained inside space 10.

So that a predefined inertization level can be set in space 10, for example as a function of the fire load of said space 10 or at specific times or upon the occurrence of specific events, the controller 11 is provided with a control interface 38, via which a user can input target values for the inertization level to be set and/or maintained.

At least one oxygen sensor 4 is preferably disposed within space 10 to measure the oxygen content of the internal air atmosphere of space 10 continuously or at predefinable times or upon the occurrence of specific events. The oxygen value measured by said sensor 4 can be sent to controller 11 via a signal line 39. It is conceivable to employ an aspirative system which continually extracts representative samples of the internal air atmosphere of the space through a (not explicitly shown) pipeline or duct system and feeds said samples to the oxygen sensor 4. It is however, also conceivable for at least one oxygen sensor 4 to be arranged directly inside space 10.

As already indicated, the inert gas is stored in container 1 in liquefied form in the preferred embodiment of the device according to the invention. The container 1 is preferably realized as a double-walled cooling tank for permanent heat insulation. To this end, the container 1 can comprise an inner container 36 and a supporting outer container 24. The inner container 36 is for example manufactured from heat-resistant CrNi steel, while structural steel etc. comes into play as the material for the outer container 24. The space between the inner container 36 and the outer container 32 can be lined with perlite and additionally insulated by means of a vacuum. This renders particularly good heat insulation.

So that the vacuum in the space between the inner container 36 and the outer container 24 can be restored or recalibrated as necessary, the container 1 exhibits a vacuum connection 18, to which the corresponding vacuum pumps can for example, be connected.

The cooling tank employed in the preferred embodiment of the inventive solution is configured such that the pressure in inner container 36 remains constant even when container 1 is being filled with liquid inert gas such that inert gas can be extracted in the fluid form without any problems even during the fueling via the fluid gas line 8. To actually fill container 1, for example by a tanker, deep-frozen inert gas is pumped through a filling connection 28 in a filling line 34. The filling line 34 is connected to the inner container 36 of inert gas container 1 by means of valves 29 to 32. During the filling of container 1, liquid gas extraction is also possible by means of the optional liquid gas sampling connection, the inert gas sampling connection 33 respectively.

Since in the embodiment according to FIG. 1, the vaporizer 16 is arranged within the enclosed space 10, said vaporizer 16 extracts the entire amount of heat needed to vaporize the inert gas 37 fed in fluid form to said vaporizer 16 directly from the internal air atmosphere of the enclosed space 10. As indicated above, the associated cooling effect can thus, be used in order to cool the internal air atmosphere of the enclosed space 10 accordingly. This cooling effect can be used—in particular when the space 10 is to be kept permanently cool (cold storage) or when waste heat generated by electronic devices, etc. is to be discharged from space 10, in particular over a longer period of time—to correspondingly lower the cooling output needed to be provided by the air conditioning system to air condition (cool) the space 10 and in particular reduce the running costs of the system as a whole.

The cooling effect used to cool the internal air atmosphere of space 10 is particularly rendered when inert gas is discharged into the internal air atmosphere of space 10 in order to set and/or maintain a specific inertization level in same. In particular, thermal energy is then namely extracted from the internal air atmosphere of space 10, a consequence of which is the corresponding cooling of the internal air atmosphere of space 10.

As a further option, also implemented in the embodiment shown in FIG. 1, a further vaporizer 20 can be provided additionally to the vaporizer 16 disposed inside space 10; arranged, however, external said space 10. This additional vaporizer 20 is preferably connected to the cooling tank configured as container 1 by means of a supply line 46. The additional vaporizer 20 preferably serves to vaporize the inert gas extracted from container 1 via the supply line 46 as needed. The amount of the inert gas supplied to the additional vaporizer 20 can be regulated by means of a valve 19 allocated to the supply line 46, specifically by said valve 19 preferably being accordingly actuated by the controller 11.

At least part of the inert gas vaporized in additional vaporizer 20 can likewise be introduced into the enclosed space 10, for example via outlet nozzles 2, for instance in order to set or maintain a specific inertization level in the internal air atmosphere of enclosed space 10. As depicted, the outlet of the additional vaporizer 20 is connectable to the supply line 3 and the outlet nozzles 2 arranged inside the space 10 via the valve 21 configured here as a three-way valve. Additionally, the outlet of the additional vaporizer 20 can also be connected to an inert gas sampling connection 44 so as to enable the user of the system also being able to extract gaseous inert gas from the container 1 when outside space 10.

Providing the additional vaporizer 20, arranged external the space 10 and thus, drawing no thermal energy from the internal air atmosphere within the space when in operation (i.e., when vaporizing inert gas), it is then also possible for a continuous inertization to be set or maintained in space 10 when cooling of the space 10 by extraction of the heat of vaporization is not or no longer desired. By the controller 11 actuating the corresponding valves 9 and 19, by means of which the vaporizer 16 disposed within the space 10 on the one hand and the additional vaporizer 20 disposed outside the space on the other are connected to the inert gas container 10, it is possible to either set or maintain a specific inertization level in the enclosed space 10 by the supply or replenishment of inert gas, whereby the heat energy needed to vaporize the inert gas can either be taken from the internal air atmosphere within the space or the external ambient air in a regulated manner.

Figure 2:
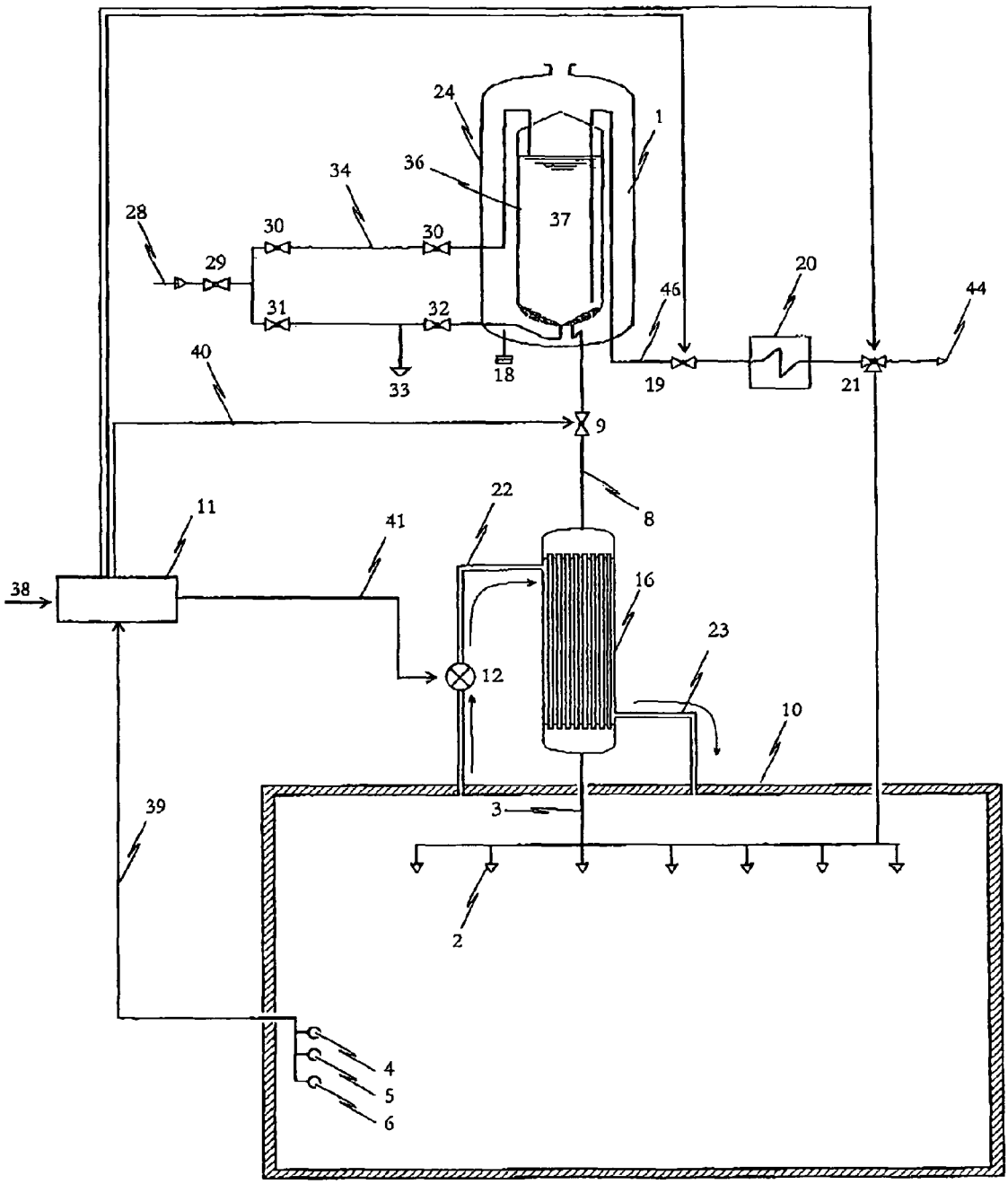
FIG. 2 is a schematic view of a second embodiment of the device according to the invention.

FIG. 2 shows a schematic representation of a second preferred embodiment of the solution according to the invention. This embodiment differs from the system depicted in FIG. 1 in that no vaporizer is provided within space 10. Employed instead is a vaporizer 16, connected to the inert gas container 1 by means of a liquid gas supply line 8, which is disposed—as is also the additional vaporizer 20—external of space 10. Valve 9 is provided in the liquid gas supply line 8 to the vaporizer 16, said valve being actuatable by controller 11 in order to provide a regulated supply of the liquefied inert gas 37 stored in the inert gas container 1 to the vaporizer 16.

The (liquid) inert gas supplied to the vaporizer 16 via the liquid gas supply line 8 is vaporized in vaporizer 16 and subsequently supplied via supply line 3 to the outlet nozzles 2 arranged inside space 10. A plurality of outlet nozzles 2 are hereto preferably arranged in distributed fashion inside said space 10 so as to be able to distribute the inert gas introduced into the space 10 as evenly as possible.

The vaporizer 16 employed in the embodiment depicted in FIG. 2 is preferably realized as a vaporizer which, without any external power being supplied, can maintain a "moderate" temperature in enclosed space 10 only by drawing on the internal ambient air. Vaporization of the supplied liquid inert gas 37 in vaporizer 16 is possible at this moderate temperature. To this end, the unit cooler 16 is configured as a heat exchange system, by means of which the inert gas 37 to be vaporized on the one hand and a volume of air extracted from the internal air atmosphere of the space 10 on the other is conducted.

So that the amount of air necessary to heat the vaporizer 16 can be taken from the internal air atmosphere of the space, the heat exchange system of the vaporizer 16 includes an air duct system 22, 23. Said air duct system exhibits a hot air duct 22, which draws on a pump mechanism 12, for example, to extract a portion of the internal ambient air as needed and supply same to the vaporizer 16, respectively the heat exchanger of the vaporizer 16.

The set amount of the space's internal ambient air supplied to the vaporizer 16 of the heat exchanger can be regulated by the controller 11. The controller 11 sends the corresponding control signals to the pumping mechanism 12 via control line 41 so that the delivery rate and also the direction of conveyance of the pumping mechanism 12 can be adjusted as needed. It is hereby conceivable for the controller 11 to regulate the delivery rate of the pumping mechanism 12, for example as a function of a target operating temperature for vaporizer 16 and the actual temperature of vaporizer 16, the heat exchanger of the vaporizer 16 respectively. In this case, the vaporizer 16, the heat exchanger of the vaporizer 16 respectively, should be provided with a (not explicitly depicted in the figures) temperature sensor with which the working temperature of the vaporizer 16 can be measured continually or at predefined times or events. This actual operating temperature is subsequently forwarded to the controller 11 which compares the actual operating temperature with a predefined target value and sets the delivery rate of the pumping mechanism 12 accordingly. The user of the system can input the target temperature value into the controller 11 via the interface 38.

After a heat transfer has occurred in the heat exchanger of vaporizer 16 from the amount of internal ambient air to the inert gas 37 supplied (and to be liquefied) to the vaporizer 16, the volume of air thus cooled is then fed through a cold air duct 23 of the air duct system back into the internal air of the enclosed space 10. As mentioned above, the heat extracted from the amount of air is used to vaporize the liquefied inert gas 37 in the vaporizer 16.

The embodiment of the inventive solution depicted in FIG. 2 allows the cooling effect which occurs when the inert gas 37 is vaporized, to be employed to cool the internal air atmosphere of the enclosed space 10 in regulated manner. It is in particular possible to set the delivery rate, the pumping capacity respectively, of the pumping mechanism 12 with the controller 11 by transmitting the appropriate signal via the control line 41. By regulating the delivery rate or pumping capacity of pumping mechanism 12, the amount of air to flow through the heat exchanger of vaporizer 16 and used to heat the inert gas to be vaporized and supplied to the space 10, can be set per unit of time. It is evident that with a lower pumping capacity of pumping mechanism 12, the vaporizer 16 is operationally restricted such that the quantity of liquid gas to be vaporized by the vaporizer 16 per unit of time needs to be reduced accordingly by means of the valve 9.

As already described in conjunction with the first embodiment making reference to FIG. 1, an additional vaporizer 20 is also provided in the second embodiment which works independently of vaporizer 16 and is connected to the inert gas container 1 via line 46. The additional vaporizer 20 is designed to vaporize the inert gas 37 supplied by line 46 without taking the heat of vaporization from the internal air atmosphere of space 10.

Figure 3:
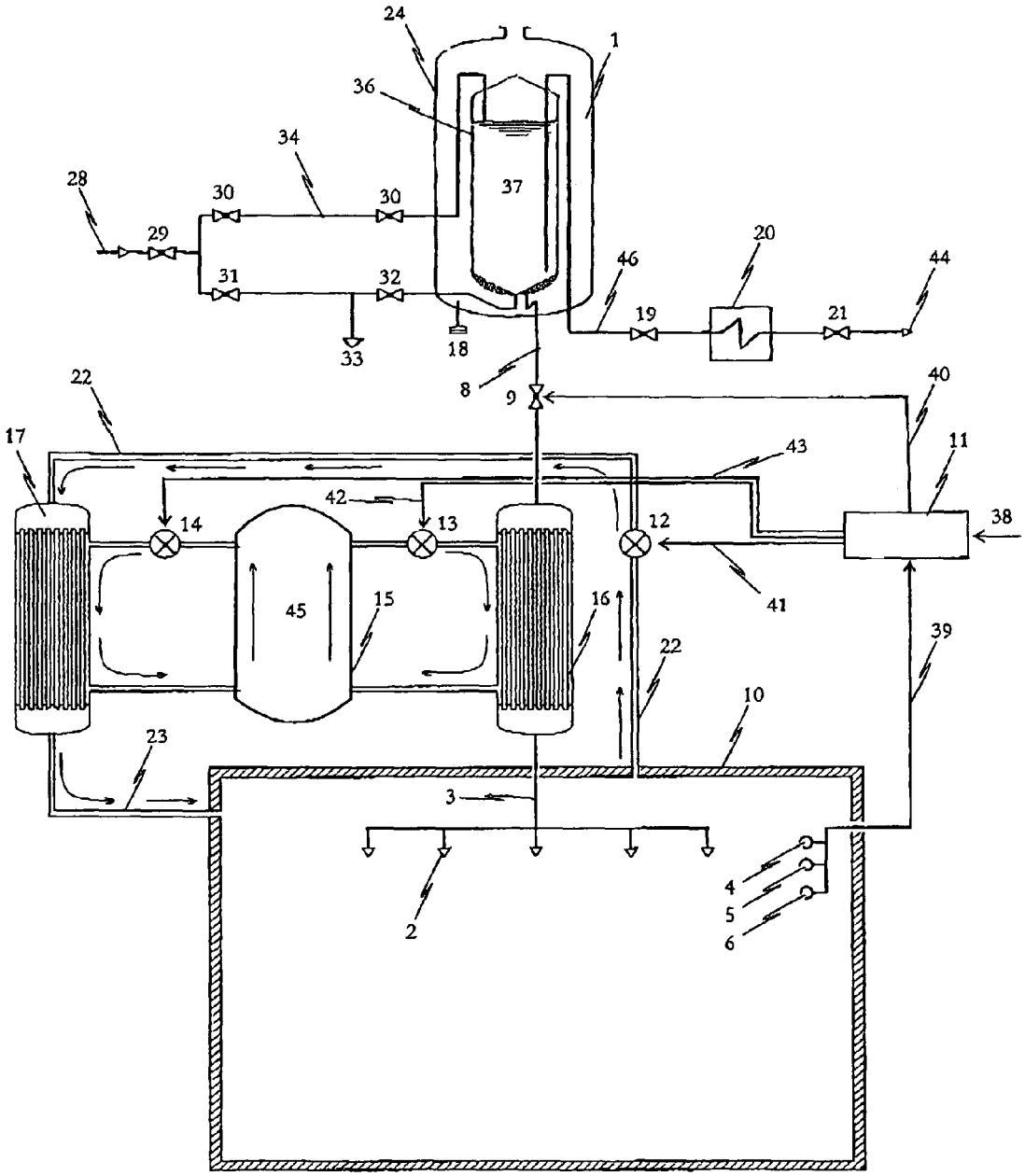
FIG. 3 is a schematic view of a third embodiment of the device according to the invention.

FIG. 3 depicts a third embodiment of the solution according to the invention. This third preferred embodiment essentially corresponds to the embodiment depicted in FIG. 2, however with the exception here that the heat exchanger associated with the vaporizer 16 is only heated indirectly by the internal ambient air of the enclosed space 10.

To this end, the third embodiment provides for the heat exchanger of the vaporizer 16 (as cooling medium) to be operated with a liquid heat exchange medium 45. The heat exchange medium 45 is stored in a heat exchange tank 15. So that a heat transfer from the heat exchange medium 45 to the inert gas to be vaporized and fed to space 10 can take place in the vaporizer 16, two connections of the heat exchanger of vaporizer 16 are connected to the heat exchange tank 15 via a supply line and a drain line.

Using a pumping mechanism 13 actuatable by the controller 11 via a control line 42, at least a portion of the heat exchange medium 45 stored in the heat exchange tank 15 can thus be fed to the heat exchanger of the vaporizer 16 as cooling medium. The portion of the heat exchange medium 45 supplied to the heat exchanger of vaporizer 16 flows through the heat exchanger of vaporizer 16 and thereby releases thermal energy to the inert gas to be vaporized and heated in vaporizer 16. The heat exchange medium 45 cooled in the heat exchanger of vaporizer 16 is then subsequently re-fed to the heat exchange tank 15.

The system in accordance with FIG. 3 additionally provides for a further heat exchanger 17, through which a portion of the space's internal air atmosphere on the one hand and the heat exchange medium 45 stored in the heat exchanger tank 15 on the other are conveyed. Specifically, additional heat exchanger 17 is connected to space 10 by means of an air duct system 22, 23. As is also the case with the embodiment according to FIG. 2, the air duct system depicted in FIG. 3 comprises a hot air duct 22, via which a portion of the space's internal air atmosphere can be extracted and supplied to the additional heat exchanger 17 as needed using, for example, the pumping mechanism 12.

The set volume of internal space air supplied to the additional heat exchanger 17 can be regulated with controller 11. The controller 11 sends the pumping mechanism 12 the corresponding control signals hereto via control line 41 so that the delivery rate and also the direction of conveyance can be set as need be for the pumping mechanism 12. It is hereby conceivable for the controller 11 to set the delivery rate of the pumping mechanism 12 for example as a function of a target temperature for space 10 and the actual temperature of space 10.

In this case, at least one temperature sensor 5 should be provided inside the space 10 by means of which the actual temperature of the space 10 is measured continually or at predefined times or events. The measured temperature value is then forwarded to the controller 11 which compares the actual temperature value with a predefined target value and sets the delivery rate of the pumping mechanism 12 accordingly.

In order to achieve a heat transfer in the additional heat exchanger 17 from the air extracted by the pumping mechanism 12 from the internal air atmosphere of the space, two connections of the additional heat exchanger 17 are connected to the heat exchange tank 15 via a supply line and a drain line. Using a pumping mechanism 14 actuatable by the controller 11 via a control line 43, at least a portion of the heat exchange medium 45 stored in the heat exchange tank 15, which is cooled accordingly during the operation of the vaporizer 16, can be supplied to the additional heat exchanger 17 as medium to be heated. The portion of the heat exchange medium 45 supplied to the additional heat exchanger 17 flows through said additional heat exchanger 17 and thereby absorbs thermal energy from the space's internal air to be cooled in said additional heat exchanger 17. The heated heat exchange medium 45 in the additional heat exchanger 17 is then subsequently fed back to heat exchange tank 15.

After a heat transfer of the supplied quantity of air to the heat exchange medium 45 has taken place in the additional heat exchanger 17, the thereby cooled quantity of air is fed via the cold air duct 23 of the air duct system back into the internal air atmosphere of the enclosed space 10.

The embodiment of the inventive solution depicted in FIG. 3 allows for the indirect use of the cooling effect occurring when the inert gas 37 is vaporized to cool the internal air atmosphere of enclosed space 10 in regulated manner. It is in particular possible to set the delivery rate, the pumping capacity of the pumping mechanism 12 respectively, via the controller 11 by transmitting the corresponding signal via control line 41. By regulating the delivery rate or the pumping capacity of the pumping mechanism 12, the volume of air to flow through the additional heat exchanger 17 per unit of time as used to cool the internal air atmosphere of space 10 can be set.

Conversely, the delivery rate or pumping capacity of pumping mechanisms 13 and 14 can also be set in the embodiment shown in FIG. 3 via the controller 11 by transmitting the corresponding signals via control lines 42 and 43. By regulating the delivery rate or the pumping capacity of the respective pumping mechanisms 13, 14, the quantity of heat exchange medium 45 to flow per unit of time through the heat exchanger 16 or the additional heat exchanger 17 as used to heat the inert gas to be fed to the space 10, cool the internal air atmosphere of space 10 respectively, can be set.

As a heat exchange medium 45 having a sufficiently high enough heat capacity is used, the heat exchange medium stored in the heat exchange tank 15 can be employed as a cold or heat reservoir in order to independently supply thermal energy to the vaporizer 16 or discharge thermal energy from the internal air atmosphere of the space as needed.

The embodiment as depicted in FIG. 3 can be provided with a further vaporizer 20 additionally to vaporizer 16—as is also the case with the system in accordance with FIG. 1 or FIG. 2—which is disposed external of space 10. This additional vaporizer 20 is preferably connected to the container 1 configured as a cooling tank via a supply line 46. Said additional vaporizer 20 preferably serves in the vaporizing of an amount of inert gas extracted as needed from container 1 via the supply line 46. The amount of inert gas fed to the additional vaporizer 20 can be regulated by the valve 19 allocated to the supply line 46, in said valve 19 being accordingly actuated by the controller 11.

Also with the system depicted in FIG. 3, at least some of the inert gas vaporized in the additional vaporizer 20 can be discharged into the enclosed space 10, for example via outlet nozzles 2, in order to set or maintain a specific inertization level in the internal air atmosphere of the enclosed space 10. It is hereby in principle conceivable for the outlet of the additional vaporizer 20 to be connected to the supply line 3 and the outlet nozzles 2 arranged inside space 10 by means of a valve configured, for example, as a three-way valve.

Further provided in the preferred embodiments of the inventive solution depicted in the drawings, is a temperature-measuring mechanism 5 to measure the temperature of the internal air atmosphere of enclosed space 10 and an oxygen-measuring mechanism 4 to measure the oxygen content in the internal air atmosphere of enclosed space 10. By means of said temperature-measuring mechanism 5, the actual temperature prevailing within the enclosed space 10 can be measured continually or at predefined times and/or upon the occurrence of predefined events.

In the embodiment depicted in FIG. 1, the controller 11 is thereby preferably designed to actuate the two valves 9 and 21 as well as an air conditioning system (not depicted) as a function of the actual temperature measured together with a predefined target temperature on the one hand and, on the other, as a function of the oxygen content measured together with a predefined inertization level. Both the amount of inert gas to be supplied the space 10 as well as the heat energy extracted from the internal air atmosphere of the space in the vaporization of the supplied inert gas are regulated with valves 9 and 21. Should the cooling effect be insufficient during the vaporization of the inert gas to set or maintain a specific temperature within space 10, the controller 11 will activate the (not shown) air conditioning system accordingly.

On the other hand, it is preferred for the controller 11 in the embodiment according to FIG. 2 to be designed to also actuate the two valves 9, 21 and the pumping mechanism 12 as well as an air conditioning system (not depicted) as a function of the measured actual temperature together with a predefined target temperature on the one hand and, on the other, as a function of the measured oxygen content together with a predefined inertization level. On the one hand, the amount of inert gas to be supplied the space 10 is regulated with valves 9 and 21. On the other, the amount of heat extracted by the vaporizer 16 from the internal air atmosphere of the space is regulated by the delivery rate of the pumping mechanism 12. Should the cooling effect provided by the vaporizer 16 be insufficient to set or maintain a specific temperature within space 10, the controller 11 will activate the (not shown) air conditioning system accordingly.

In the embodiment as represented by FIG. 3, the controller 11 is preferably designed to actuate an air conditioning system (not depicted) as a function of the actual temperature measured together with a predefined target temperature on the one hand and, on the other, as a function of the oxygen content measured together with a predefined inertization level as well as valve 9 and the pumping mechanisms 12 to 14. The amount of inert gas to be supplied the space 10 is regulated with valve 9. The amount of heat supplied to the vaporizer 16 is regulated by the delivery rate of pumping mechanism 13, while the amount of heat discharged from the internal air atmosphere of the space is regulated with pumping mechanisms 12 and 14. Should the cooling effect attainable with the additional heat exchanger 17 be insufficient to set or maintain a specific temperature within space 10, the controller 11 will activate the (not shown) air conditioning system accordingly.

The systems depicted in the drawings are not only applicable to fire prevention in which the inflammability of goods stored in enclosed spaces is lowered by means of a preferably sustained lowering of the oxygen content in the internal air atmosphere of said enclosed space 10. It is instead also conceivable that in the event of a fire or as otherwise needed, the oxygen content of the internal air atmosphere within the space can be further lowered to a specific full inertization level, specifically by the regulated feeding of inert gas into the space's internal air atmosphere.

The setting (and maintaining) of the full inertization level can for example ensue for the purpose of extinguishing a fire. In this case, it is preferred for the system to further include a fire detection device 6 to measure a fire characteristic in the atmosphere of enclosed space 10. On the other hand, it is however also conceivable for the lowering to the full inertization level to ensue as a function of the merchandise stored in the enclosed space 10 and in particular its ignition behavior. It is accordingly possible to set a full inertization level in space 10 as a fire prevention measure when particularly highly flammable goods are stored for example in said space.

Thus, it should be emphasized that the above-described embodiments of the invention are merely possible examples of implementations set forth for a clear understanding of the principles of the invention. Variations and modifications may be made to the above-described embodiments of the invention without departing from the spirit and principles of the invention. All such modifications and variations are intended to be included herein within the scope of the invention and protected by the following claims.

The invention claimed is:

1. A method of preventing fires and extinguishing fires in an enclosed space, comprising:

air conditioning the enclosed space such that an internal air atmosphere in the enclosed space is not permitted to exceed a predefined temperature value;

providing a liquefied inert gas, comprising nitrogen, in a container;

supplying at least a portion of the provided liquefied nitrogen gas to a vaporizer;

vaporizing said at least portion of the provided liquefied nitrogen gas in same; and supplying a regulated amount of the liquefied nitrogen gas vaporized in the vaporizer to the internal air atmosphere of the enclosed space such that an oxygen content in the atmosphere of the enclosed space one of drops to a specific inertization level and is maintained at same or is maintained at a specific, preset inertization level, wherein a heat energy needed to vaporize the liquefied nitrogen gas in the vaporizer is extracted from the internal air atmosphere of the enclosed space.

2. The method according to claim 1, wherein the liquefied nitrogen gas provided is vaporized within the enclosed space, and wherein the liquefied nitrogen gas is supplied in liquid form to the vaporizer disposed within said space prior to the step of vaporizing.

3. The method according to claim 1, wherein the liquefied nitrogen gas provided is vaporized external the enclosed space, and wherein at least a portion of the heat energy needed to vaporize the liquefied nitrogen gas is extracted from the internal air atmosphere of the enclosed space by heat conduction.

4. The method according to claim 3, wherein an adjustable amount of the heat energy extracted from the internal air atmosphere of the enclosed space needed to vaporize the liquefied nitrogen gas is regulated by setting a heat conductivity of a heat conductor used to extract the required amount of energy as a function of an actual current temperature within the enclosed space and/or a predefinable target temperature.

5. The method according to claim 3, wherein a unit cooler is used to vaporize the at least portion of the liquefied nitrogen gas provided, and wherein the method further comprises:

supplying air from the internal air atmosphere of the enclosed space from the vaporizer or a heat exchanger allocated to said vaporizer, as heated air, in a regulated manner, at least during the vaporization of the liquefied nitrogen gas;

providing the heat energy needed to vaporize the liquefied nitrogen gas from at least partly extracting same by heat conduction from the air supplied by the vaporizer or the heat exchanger as heated air, whereby the air supplied as heated air cools; and feeding the cooled air back again into space.

6. The method according to claim 5, wherein an amount of the air supplied as heated air to the vaporizer or the heat exchanger is adjustable as a function of the actual current temperature within the enclosed space and/or a predefinable target temperature.

7. The method according to claim 6, wherein the supplying the regulated amount of liquefied nitrogen gas step further comprises:

measuring the oxygen content in the enclosed space; and supplying the liquefied nitrogen gas vaporized in the vaporizer as a function of the measured oxygen value of the internal air atmosphere of the enclosed space in order to maintain the oxygen content in the atmosphere of the enclosed space at a specific inertization level.

8. The method according to claim 7, wherein the specific inertization level is a basic inertization level, and wherein after the supplying the regulated amount of liquefied nitrogen gas step, in the event of a fire or when otherwise needed, the oxygen content in the internal air atmosphere is further lowered to a specific full inertization level by the regulated supplying of liquefied nitrogen gas into the internal air atmosphere.

9. The method according to claim 8, wherein a detector for fire characteristics identifies whether a fire has broken out in the enclosed space.

10. The method according to claim 9, wherein the lowering to the full inertization level in the supplying the regulated amount of liquefied nitrogen gas step, is subject to a fire characteristic value measured by the detector.

11. The method according to claim 8, wherein the lowering to the full inertization level step is subject to the ignition behavior of the merchandise stored in the enclosed space.

12. The method according to claim 11, wherein the liquefied nitrogen gas supplied is provided in the container, which is configured as a cooling tank and vaporized with the vaporizer.

13. The method according to claim 1, wherein the enclosed space comprises one of a cold storage area or an information technology (IT) room.

* * * * *